US010046948B2

(12) United States Patent
Garfinkel et al.

(10) Patent No.: US 10,046,948 B2
(45) Date of Patent: Aug. 14, 2018

(54) VARIABLE ELEVATOR ASSIGNMENT

(71) Applicant: Otis Elevator Company, Farmington, CT (US)

(72) Inventors: Michael Garfinkel, West Hartford, CT (US); Theresa M. Christy, West Hartford, CT (US); Jannah A. Stanley, Portland, CT (US); Harold Terry, New Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 66 days.

(21) Appl. No.: 15/315,405

(22) PCT Filed: Jun. 3, 2015

(86) PCT No.: PCT/US2015/033958

§ 371 (c)(1),
(2) Date: Dec. 1, 2016

(87) PCT Pub. No.: WO2015/191345

PCT Pub. Date: Dec. 17, 2015

(65) Prior Publication Data

US 2017/0096318 A1 Apr. 6, 2017

Related U.S. Application Data

(60) Provisional application No. 62/007,636, filed on Jun. 4, 2014.

(51) Int. Cl.
*B66B 1/46* (2006.01)

(52) U.S. Cl.
CPC ..... *B66B 1/468* (2013.01); *B66B 2201/233* (2013.01)

(58) Field of Classification Search
CPC ..... B66B 1/468; B66B 2201/233
(Continued)

(56) References Cited

U.S. PATENT DOCUMENTS 4,852,695 A * 8/1989 Ostrowiecki ..... B66B 1/20 187/380
5,024,295 A * 6/1991 Thangavelu ..... B66B 1/2458 187/382

(Continued)

FOREIGN PATENT DOCUMENTS

JP 2006124075 A 5/2006

OTHER PUBLICATIONS

International Search Report and Written Opinion for application PCT/US2015/033, dated Sep. 15, 2015, 10 pages.

*Primary Examiner* — David Warren
(74) *Attorney, Agent, or Firm* — Cantor Colburn LLP

(57) ABSTRACT

A system 110 includes an input/output 113 unit for receiving a user request to call an elevator 101, 102 and a processor 111 for processing the user request to assign an elevator to the user 105. The processor performs one of a first assignment process and a second assignment process. The first assignment process includes determining whether a delay condition exists for delaying assignment of the elevator to the user 202, delaying assignment of the elevator to the user based on determining that the delay condition exists 203, and assigning the elevator to the user based on determining that the delay condition does not exist 204. The second assignment process includes assigning the elevator to the user and notifying the user of the assignment, determining whether an assignment change condition exists 206, changing the assignment to another elevator based on determining that the assignment change condition exists 207, and notifying the user of the assignment change 208.

15 Claims, 2 Drawing Sheets

(58) Field of Classification Search
USPC ..... 187/388
See application file for complete search history.

(56) References Cited

U.S. PATENT DOCUMENTS

| | | | | |
|---|---|---|---|---|
| 5,146,053 | A * | 9/1992 | Powell | B66B 1/2458 187/388 |
| 5,551,532 | A | 9/1996 | Kupersmith | |
| 5,714,725 | A * | 2/1998 | Thangavelu | B66B 1/2458 187/380 |
| 5,750,946 | A * | 5/1998 | Thangavelu | B66B 1/2458 187/382 |
| 5,767,460 | A * | 6/1998 | Thangavelu | B66B 1/2458 187/380 |
| 5,767,462 | A * | 6/1998 | Thangavelu | B66B 1/2458 187/382 |
| 5,808,247 | A * | 9/1998 | Thangavelu | B66B 1/2458 187/382 |
| 5,841,084 | A * | 11/1998 | Thangavelu | B66B 1/2458 187/382 |
| 7,377,364 | B2 | 5/2008 | Tyni et al. | |
| 7,510,054 | B2 * | 3/2009 | Bahjat | B66B 1/18 187/247 |
| 7,610,995 | B2 | 11/2009 | Ylinen et al. | |
| 7,882,938 | B2 | 2/2011 | Blackaby et al. | |
| 8,348,021 | B2 | 1/2013 | Finschi | |
| 2009/0301820 | A1 * | 12/2009 | Stanley | B66B 1/34 187/382 |
| 2011/0155515 | A1 * | 6/2011 | Suzuki | B66B 1/2458 187/382 |
| 2011/0284329 | A1 | 11/2011 | Nakagawa | |
| 2017/0088394 | A1 * | 3/2017 | Smith | B66B 1/2458 |
| 2017/0096318 | A1 * | 4/2017 | Garfinkel | B66B 1/468 |

* cited by examiner

VARIABLE ELEVATOR ASSIGNMENT

BACKGROUND OF THE INVENTION

Embodiments of the present invention relate to elevator systems, and in particular to variable assignments of elevators to users.

Conventional elevator systems require a user to press a button on a user's floor to call an elevator and then to press another button in the elevator to indicate a floor to which the passenger desires to travel. Recently, elevator assignment systems have been developed to allow a user to select a destination floor when calling the elevator. A terminal located next to a group of elevator doors may be used to receive an elevator call from a user as well as a floor selection by the user. The elevator assignment system then uses the terminal to notify the user of an elevator assignment. This may allow for more efficient elevator assignment, since an elevator assignment system knows the floors to which passengers wish to travel and can assign elevators accordingly. Since only one user at a time can access the terminal, assignments must be provided right away. However, if there is a change in circumstances, the elevator assignment may no longer be the most efficient assignment for getting a user to their destination.

BRIEF DESCRIPTION OF THE INVENTION

Embodiments of the invention include a system for assigning an elevator to a user. The system includes an input/output unit for receiving a user request to call an elevator and a processor for processing the user request to assign an elevator to the user. The processor performs one of a first assignment process and a second assignment process. The first assignment process includes determining whether a delay condition exists for delaying assignment of the elevator to the user. The delay condition is based on one or more of an elevator position, a user position, an elevator arrival time, and a user arrival time at elevator doors. The first assignment process further includes delaying assignment of the elevator to the user based on determining that the delay condition exists, and assigning the elevator to the user based on determining that the delay condition does not exist. The second assignment process includes assigning the elevator to the user and notifying the user of the assignment, determining whether an assignment change condition exists, changing the assignment to another elevator based on determining that the assignment change condition exists, and notifying the user of the assignment change.

Embodiments of the invention also include method for assigning an elevator to a user. The method includes receiving a user request to call an elevator and based on receiving the user request, performing at least one of a first assignment process and a second delay assignment process. The first delay assignment process includes determining whether a delay condition exists for delaying assignment of the elevator to the user, delaying assignment of the elevator to the user based on determining that the delay condition exists, and assigning the elevator to the user based on determining that the delay condition does not exist. The second assignment process of assigning the elevator to the user and notifying the user of the assignment, determining whether an assignment change condition exists, changing the assignment to another elevator based on determining that the assignment change condition exists, and notifying the user of the assignment change.

In the above embodiment, or as an alternative, one of the delay condition and the assignment change condition may be a user arrival time at an elevator door.

In the above embodiments, or as an alternative, one of the delay condition and the assignment change condition may include a distance of the user from the elevator door.

In the above embodiments, or as an alternative, one of the delay condition and the assignment change condition may include a distance of the elevator from an elevator door corresponding to a floor associated with the user.

In the above embodiments, or as an alternative, one of the delay condition and the assignment change condition may include a time of arrival of the elevator at a floor associated with the user.

In the above embodiments, or as an alternative, one of the delay condition and the assignment change condition may include an elevator deceleration point.

In the above embodiments, or as an alternative, the means for processing the user request may be configured to delay assignment of the elevator to the user based on determining that the delay condition exists, and the means for processing the user request may be configured to determine whether a decision point has been reached by which an assignment must be made, and to assign the elevator to the user based on the decision point being reached.

In the above embodiments, or as an alternative, the decision point may be a point at which the elevator begins decelerating upon approaching a floor associated with the user.

In the above embodiments, or as an alternative, the method may include delaying the assignment of the elevator to the user based on determining that the delay condition exists, determining whether a decision point has been reached by which an assignment must be made, and assigning the elevator to the user based on the decision point being reached.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Elevator systems may receive destination information from a user at the time an elevator is called to more efficiently assign elevators to users. However, if circumstances change from the time of assignment, the assigned elevator may no longer be the most efficient. Embodiments of the invention relate to varying elevator assignments by performing one of an elevator assignment delay and an elevator assignment change.

Figure 1:
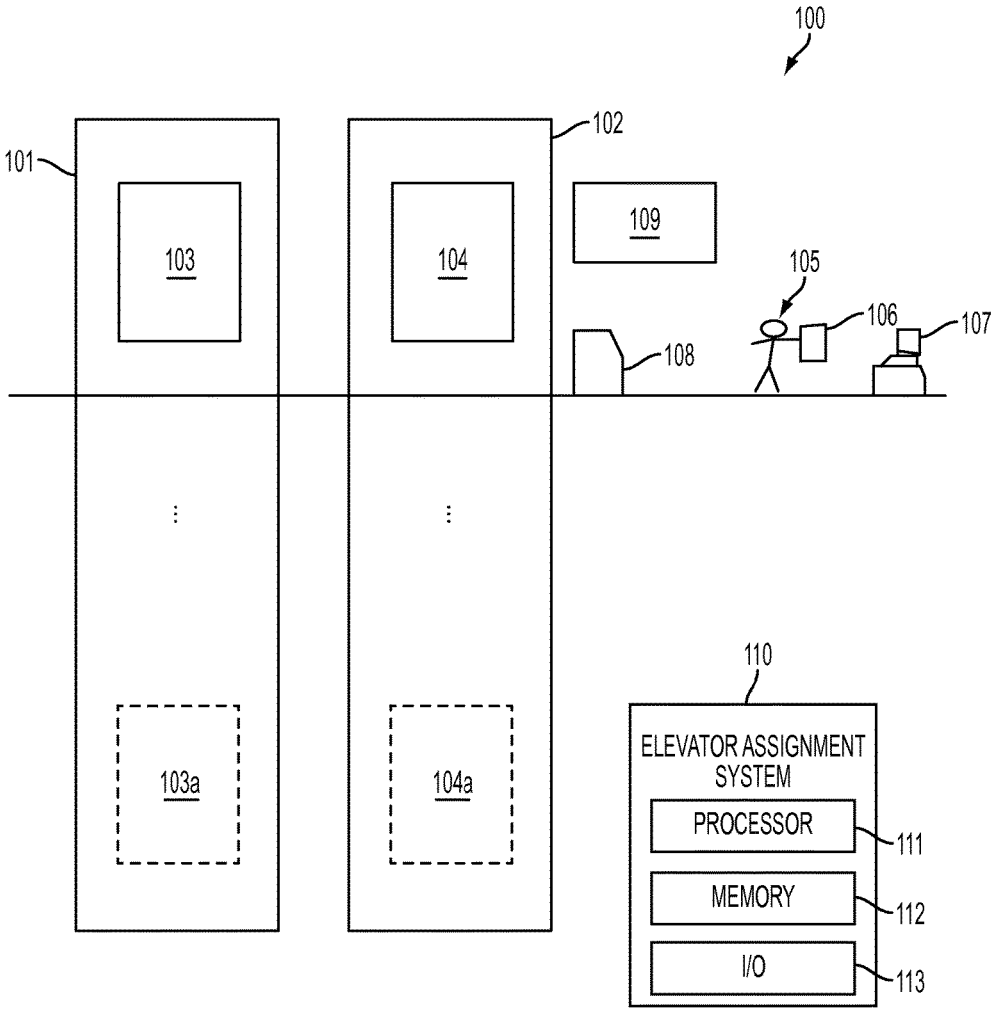
FIG. 1 illustrates an elevator system according to an embodiment of the invention.

FIG. 1 is a diagram of a system 100 according to an embodiment of the invention. The system 100 includes a first elevator shaft 101 to accommodate an elevator car 103 and a second elevator shaft 102 to accommodate a second elevator car 104. In operation, a user 105 utilizes one of a portable communications device 106, a remote computer 107, or a local computer 108 to send a request to the elevator assignment system 110 to call an elevator. The elevator assignment system 110 then either performs a first elevator assignment operation, in which it delays assignment of an elevator based on a predetermined delay condition, or a second elevator assignment operation in which it assigns the elevator to the user 105, then changes the assignment based on a predetermined assignment change condition. Alternatively, the elevator assignment system 110 may perform both the first and second elevator assignment operations consecutively. Based on the performance of one or both of the first and second elevator assignment operations, the elevator assignment system 110 assigns an elevator to the user 105 and notifies the user of the assignment via one or more of the portable communications device 106, the remote computer 107, the local computer 108, and a local public display 109. It is understood that although the elevator assignment system 110 may perform one or both of the first and second elevator assignment operations, the elevator assignment system 110 may also be configured to perform any other assignment operations including providing an immediate assignment and not checking for an assignment-change condition.

In the present specification and claims, the portable communications device 106 is a wireless device capable of communicating with the elevator assignment system 110 via a wireless network, such as a local wireless network, a cellular network, group of connected wireless networks, or other wireless network. The portable communications device 106 is a device that the user 105 can readily carry while in transit, such as a cellular phone, tablet computer, or any other wireless and portable computer that a user can operate from any location within range of a connected wireless network, and which the user can operate while moving. In the present specification and claims, remote computer 107 is a stationary or semi-stationary computer that may be plugged in to a power source at one particular location, such as an office, room, or other location remote from the elevator banks 101 and 102. Examples of remote computers 107 include laptop computers and personal desktop computers. In the present specification and claims, the local computer 108 is a computer located in the vicinity of the elevator bank including the elevator shafts 101 and 102 that has a function of calling elevators for users. For example, the local computer 108 may be a computer having a control panel in a wall adjacent to the elevator shafts 101 and 102, a kiosk in the vicinity of the elevator shafts 101 or 102, or any other type of stationary local computer. The local computer 108 may communicate with the elevator assignment system 110 via wires or wirelessly. In the present specification and claims, any one of the portable communications device 106, the remote computer 107, and the local computer 108 may be used to generate an elevator call request by a user. However, any other devices may also be used to generate the elevator call requests.

In embodiments of the invention, the elevator request may be made by a user entering information into one of the portable communications device 106, the remote computer 107, or the local computer 108, such as by entering a floor number into one of these devices 106, 107, or 108. Other embodiments encompass users entering destinations other than floor numbers, such as tenant name, business name, business type, or any other information associated with an occupant of the building or a function performed by the tenant of the building in which the elevators 103 and 104 are located. The elevator assignment system 110 may then access a database in memory 112 to match the entered information (e.g. tenant name, business type) with a particular floor. The elevator assignment system 110 may then notify the user of the floor. For example, in one embodiment, the elevator assignment system 110 transmits floor information together with an elevator assignment to the device from which the user made the elevator request (e.g. the portable communications device 106, the remote computer 107, or the local computer 108). In another embodiment, the elevator assignment system transmits the floor information and elevator assignment to the portable communications device 106 regardless of the source of the request. For example, a user may enter identification information when making a request, or identification information may be stored in the remote computer 107 or portable communications device 106, such that when the user enters a request from the remote computer 107, the elevator assignment system 110 may automatically associate the portable communications device 106 with the remote computer 107, and may transmit the floor information to the portable communications device 106. In another embodiment, the elevator assignment system 110 transmits only an elevator assignment to the user (via the remote computer 107 or portable communications device 106), and not the floor information.

In yet another embodiment, floor information and the elevator assignment are transmitted to a stationary display 109 in the vicinity of the elevator shafts 101 and 102. In such an embodiment, user identification information may be displayed together with an assigned elevator on the display 109. In yet another embodiment, call request information is pre-stored in memory in a portable communications device 106 or in the elevator assignment system 110, the local computer 108 includes a detection mechanism for detecting the portable communications device 106, such as a short-range wireless communication system or radio frequency identification (RFID) system, and the destination information is automatically determined by the elevator assignment system 110 based on pre-stored data associated with the mobile communications device 106.

In other words, embodiments of the invention encompass any manner and mechanism for providing destination information to an elevator control system 110, and any manner or mechanism for providing the elevator assignment to the user 105.

The elevator assignment system 110 includes a processor 111 for processing instructions and data, memory for storing instructions and data, and at least one input/output module 113 for communicating with devices capable of calling an elevator, or issuing a request for an elevator, such as the portable communications device 106, remote computer 107, and local computer 108. The I/O 113 of the elevator assignment system 110 also communicates with devices capable of providing elevator assignment information to a user 105, such as the portable communications device 106, remote computer 107, the local computer 108, and the public local display 109. In one embodiment, the local computer 108 is a computer 108 having an interface that supports interaction with one user at a time, while the public local display 109 is a screen or other display viewable by any users in the vicinity. For example, one user at-a-time may enter destination information on the local computer 108, while elevator assignment information for all users on the floor may be displayed on the local public display 109.

In embodiments of the invention, means for receiving a user request to call an elevator may include the elevator assignment system 110, and in particular the I/O module 113, or any other computer or system capable of receiving requests from users, monitoring elevators, and assigning elevators to users. Likewise, means for processing a user request may include the processor 111 of the elevator assignment system 110, or any other computer, processor, or system capable of processing user requests.

In one embodiment, the processor 111 identifies a user request and determines whether a delay condition exists for delaying assignment of the elevator 103 or 104 to the user 105. In embodiments of the invention, the delay condition may relate to one or more of an elevator location, a user location, a time of arrival of the elevator, and a time of arrival of the user. The delay condition may include any condition that may affect which elevator would be most convenient for the user, such as which elevator would arrive at the user's location first, which elevator would arrive at the user's destination first, or which elevator has a number of occupants less than a threshold occupancy. If the delay condition does not exist, or if a delay period expires, the processor 111 then controls the I/O 113 to notify the user 105 of the elevator assignment.

In one embodiment, the delay condition is a user arrival time at an elevator door. For example, the system 110 may delay issuance of an elevator assignment to the user 105 until the user is 10 seconds away from the elevator shafts 101 and 102, taking into account a user rate of travel or an assumed rate of travel. In another embodiment, the delay condition is a distance of the user from the elevator door. For example, the system 110 may delay issuance of an elevator assignment to the user 105 until the user is 10 meters away from the elevator shafts 101 and 102, taking into account a user's location, which may be obtained from sensors in the vicinity of the elevator shafts 101 and 102, a geographic positioning system in the user's mobile communications device 106, or by any other means. In another embodiment, the delay condition is a distance of the elevator from an elevator door corresponding to a floor associated with the user. For example, the system 110 may delay issuance of an elevator assignment to the user 105 until the elevator is 10 meters away from the floor associated with the user, based on positioning data obtained from sensors in the elevator, elevator shaft, or by any other means. In another embodiment, the delay condition is a time of arrival of the elevator at a floor associated with the user. For example, the system 110 may delay issuance of an elevator assignment to the user 105 until the elevator is 10 seconds away from the floor associated with the user, taking into account a rate of travel of the elevator or an assumed rate of travel of the elevator. In another embodiment, the delay condition is an elevator deceleration point at which the elevator begins decelerating, or reaches a predetermined deceleration rate, approaching the floor associated with the user. For example, the system 110 may delay issuance of an elevator assignment to the user 105 until the elevator begins decelerating on approach to the floor associated with the user, or until the elevator's speed or deceleration rate matches a predetermined speed or deceleration rate as the elevator approaches the floor associated with the user.

In one embodiment of the invention, the processor 111 identifies the user request and provides the user with an elevator assignment. The processor 111 continues to monitor the elevator system to determine whether an assignment change condition exists. The assignment change condition may relate to one or more of an elevator location, a user location, a time of arrival of the elevator, a time of arrival of the user, requests or actions of other users, or any other condition which may require or trigger an assignment change. The assignment change condition may include any condition that may affect which elevator would be most convenient for the user, such as which elevator would arrive at the user's location first, which elevator would arrive at the user's destination first, assignment requests of other users, or which elevator has a number of occupants less than a threshold occupancy. If the assignment change condition does not exist, or if an assignment change period expires, the processor 111 maintains the assignment of the elevator to the user 105.

In one embodiment, the assignment change condition is a change in a user arrival time at an elevator door. For example, the system 110 may change an elevator assigned to a user 105 based on a change in a user-arrival time. For example, a first elevator 103 may be assigned to the user 105 based on a first user-arrival time, and the elevator assignment system 110 may change the assignment to the second elevator 104 and notify the user 105 based on the user 105 moving to the elevator bank faster than predicted or slower that predicted.

In another embodiment, the assignment change condition is a distance of the user 105 from the elevator door. For example, the system 110 may change an elevator assigned to a user 105 based on determining that the user is too far away from the elevators to make the first elevator assignment, or closer to the elevator shafts than predicted, allowing the user to catch an elevator that is to arrive sooner than the initially-assigned elevator.

In another embodiment, the assignment change condition is a change in a distance of the elevator from an elevator door corresponding to a floor associated with the user. For example, at the time of the elevator request from the user 105, the first elevator 103 may be at a location represented by reference numeral 103*a* and the second elevator 104 may be at a location represented by reference numeral 104*a* which may be the same distance or farther from the user's floor than the first elevator 103. Accordingly, the elevator assignment system 110 may provide an initial elevator assignment for the user to take the first elevator 103. However, delays may occur between the time the elevator 103 is assigned and its arrival at the user's floor, and as a result, the elevator 104 may be closer to the user's floor than the elevator 103. The elevator assignment system 110 may then change the elevator assigned to the user 105 from the first elevator 103 to the second elevator 104.

In yet another embodiment, the assignment change condition is based on a time of arrival of the elevators 103 and 104 at a floor associated with the user 105. In another embodiment, the assignment change condition is an elevator deceleration point at which the elevator begins decelerating, or reaches a predetermined deceleration rate, approaching the floor associated with the user. For example, the system 110 may assign the first elevator 103 to the user 105, but the second elevator 104 may begin the deceleration first. Accordingly, the system 110 may change the elevator assignment from the first elevator 103 to the second elevator 104.

Figure 2:
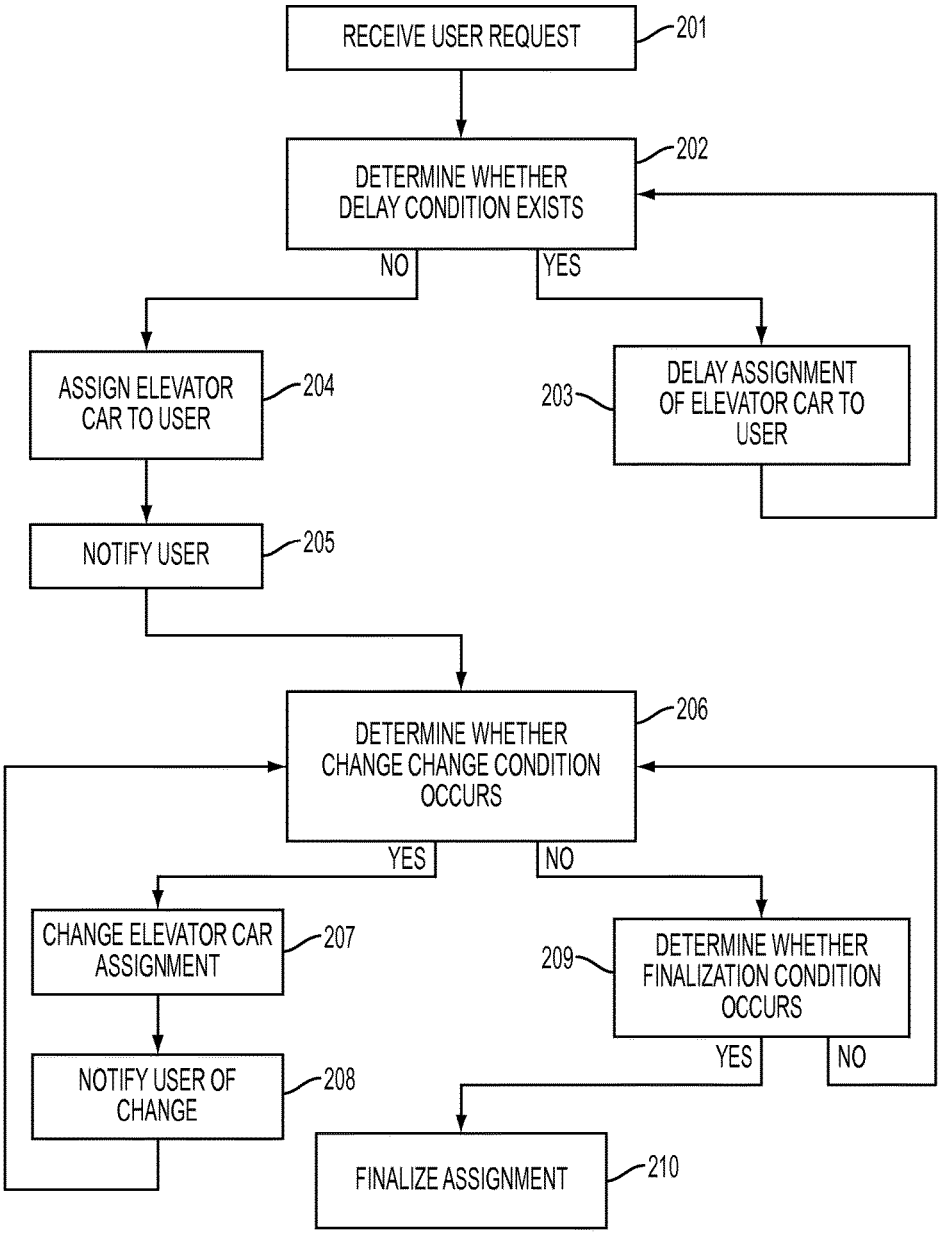
FIG. 2 is a flow diagram of a method for assigning an elevator according to an embodiment of the invention.

FIG. 2 is a flow diagram of a method according to an embodiment of the invention. In block 201, a user generates an elevator call to request an elevator and the request is received by an elevator assignment system. In block 202, the system determines whether a delay condition exists indicating that assignment of the elevator to the user should be delayed. Examples of delay conditions include user arrival times at an elevator bank, a user distance from the elevator bank, an elevator arrival time at a user's floor, and an elevator distance from the user's floor. However, embodiments of the invention encompass any delay conditions.

If the delay condition exists, then the assignment of an elevator car to the user is delayed (block 203) until it is determined that the delay condition does not exist. If the delay condition does not exist, then an elevator is assigned to the user in block 204, and the user is notified of the assignment in block 205. For example, an elevator number may be sent to a user's mobile communications device, such as cell phone, to a computer being used by the user, such as a remote computer or local computer, or to a public display device, such as a screen or monitor in the vicinity of an elevator bank.

In block 206, the elevator assignment system continually monitors the status of the elevators and determines if an assignment change is required by detecting an assignment change condition. One example of an assignment change condition is a change in arrival time of a user or elevator from elevator doors on a user's floor.

If the assignment change condition exists, the system changes the elevator assignment in block 207 and notifies the user in block 208. In some embodiments, the system continues to monitor the elevators to determine if another change condition exists. In block 209, the system determines whether a finalization condition exists and removes the user's elevator assignment from among assignments that may be changed. For example, to prevent too-frequent assignment changes, the change condition may be limited to a predetermined number of changes over a predetermined period of time. In other words, the finalization condition may be a predetermined number of assignment changes, such as 1 or 2 assignment changes.

Alternatively, the system may only change the elevator assignment if the change condition exceeds a threshold. For example, if a first elevator is initially assigned based on an earlier estimated arrival time than a second elevator, the system may change the assignment only if the second elevator subsequently has an estimated arrival time that is a predetermined period of time earlier than the first elevator, such as 5 seconds or 10 seconds. In other words, even if the second elevator has an earlier estimated arrival time at the user's floor, or at the user's destination, the system may not make an assignment change until the difference in estimated arrival times exceeds a predetermined threshold, such as 5 or 10 seconds, to prevent too-frequent changes of elevator assignments.

In yet another embodiment, the finalization condition is an estimated amount of time in which the elevator is expected to arrive at a user's floor. For example, if the elevator is 10 seconds away from the user's floor, the system may remove the user's assignment from among those that may be changed to another elevator.

When it is determined that the finalization condition exists, the system finalizes the elevator assignment in block 210, and the elevator assignment may no longer be changed. While some examples of finalization conditions have been provided, embodiments of the invention encompass any condition that may prevent further elevator assignment changes.

In the embodiment illustrated in FIG. 2, an elevator assignment system performs each of a first elevator assignment process of determining whether to delay assignment of an elevator to a user and a second elevator assignment process of determining whether to change an assignment after an initial assignment has been made. Embodiments of the invention also encompass systems and methods incorporating only one of the elevator assignment processes, rather than both processes.

While the illustrated example shows two elevators, it is understood that embodiments of the invention encompass elevator systems having any number of elevators greater than one, including multiple elevators at one bank of elevators in a building, and multiple elevators that are part of multiple different banks of elevators at different locations in a building.

Technical benefits include increasing user convenience by increasing flexibility and efficiency in assigning elevators to users.

Embodiments of the invention include a system for assigning an elevator to a user. The system includes an elevator assignment system for receiving a user request to call an elevator and for processing the user request to assign an elevator to the user. The elevator assignment system performs one of a first assignment process and a second assignment process. The first assignment process includes determining whether a delay condition exists for delaying assignment of the elevator to the user. The delay condition is based on one or more of an elevator position, a user position, an elevator arrival time, and a user arrival time at elevator doors. The first assignment process further includes delaying assignment of the elevator to the user based on determining that the delay condition exists, and assigning the elevator to the user based on determining that the delay condition does not exist. The second assignment process includes assigning the elevator to the user and notifying the user of the assignment, determining whether an assignment change condition exists, changing the assignment to another elevator based on determining that the assignment change condition exists, and notifying the user of the assignment change.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for assigning an elevator to a user, comprising:

an input/output (110) unit for receiving a user request to call an elevator; and a processor for processing the user request to assign an elevator to the user, the processor configured to perform one of a first assignment process and a second assignment process, the first assignment process including determining whether a delay condition exists for delaying assignment of the elevator to the user, the delay condition based on one or more of an elevator position, a user position, an elevator arrival time, and a user arrival time at elevator doors, the first assignment process further including delaying assignment of the elevator to the user based on determining that the delay condition exists, and assigning the elevator to the user based on determining that the delay condition does not exist, and the second assignment process including assigning the elevator to the user and notifying the user of the assignment, determining whether an assignment change condition exists, changing the assignment to another elevator based on determining that the assignment change condition exists, and notifying the user of the assignment change.

2. The system of claim 1, wherein one of the delay condition and the assignment change condition is a user arrival time at an elevator door.

3. The system of claim 1, wherein one of the delay condition and the assignment change condition includes a distance of the user from the elevator door.

4. The system of claim 1, wherein one of the delay condition and the assignment change condition includes a distance of the elevator from an elevator door corresponding to a floor associated with the user.

5. The system of claim 1, wherein one of the delay condition and the assignment change condition includes a time of arrival of the elevator at a floor associated with the user.

6. The system of claim 1, wherein one of the delay condition and the assignment change condition includes an elevator deceleration point.

7. The system of claim 1, wherein the processor is configured to delay assignment of the elevator to the user based on determining that the delay condition exists, and the processor is configured to determine whether a decision point has been reached by which an assignment must be made, and to assign the elevator to the user based on the decision point being reached.

8. The system of claim 7, wherein the decision point is a point at which the elevator begins decelerating upon approaching a floor associated with the user.

9. A method for assigning an elevator to a user, comprising: receiving a user request to call an elevator;

based on receiving the user request, performing, by an elevator assignment computer, at least one of a first assignment process of determining whether a delay condition exists for delaying assignment of the elevator to the user, delaying assignment of the elevator to the user based on determining that the delay condition exists, and assigning the elevator to the user based on determining that the delay condition does not exist, and a second assignment process of assigning the elevator to the user and notifying the user of the assignment, determining whether an assignment change condition exists, changing the assignment to another elevator based on determining that the assignment change condition exists, and notifying the user of the assignment change.

10. The method of claim 9, wherein one of the delay condition and the assignment change condition is a user arrival time at an elevator door.

11. The method of claim 9, wherein one of the delay condition and the assignment change condition includes a distance of the user from the elevator door.

12. The method of claim 9, wherein one of the delay condition and the assignment change condition includes a distance of the elevator from an elevator door corresponding to a floor associated with the user.

13. The method of claim 9, wherein one of the delay condition and the assignment change condition includes a time of arrival of the elevator at a floor associated with the user.

14. The method of claim 9, wherein one of the delay condition and the assignment change condition includes an elevator deceleration point.

15. The method of claim 9, wherein the method includes delaying the assignment of the elevator to the user based on determining that the delay condition exists, and the method includes determining whether a decision point has been reached by which an assignment must be made, and assigning the elevator to the user based on the decision point being reached.

* * * * *